US008622412B2

(12) United States Patent
Pivato et al.

(10) Patent No.: US 8,622,412 B2
(45) Date of Patent: Jan. 7, 2014

(54) WHEELCHAIR WITH LIFT

(75) Inventors: Emma Pivato, Edmonton (CA); Jonathan Tyler, Edmonton (CA)

(73) Assignee: Alexis Enterprises Ltd., Edmonton, Alberta (CA)

( * ) Notice: Subject to any disclaimer, the term of this patent is extended or adjusted under 35 U.S.C. 154(b) by 0 days.

(21) Appl. No.: 13/614,463

(22) Filed: Sep. 13, 2012

(65) Prior Publication Data

US 2013/0168945 A1 Jul. 4, 2013

Related U.S. Application Data

(60) Provisional application No. 61/581,837, filed on Dec. 30, 2011.

(51) Int. Cl.
*A61G 5/10* (2006.01)
*A61G 7/10* (2006.01)

(52) U.S. Cl.
CPC ..... *A61G 7/1046* (2013.01)
USPC ..... 280/304.1

(58) Field of Classification Search
USPC ..... 4/480; 5/81.1 R, 83.1, 87.1, 86.1; 280/80.1, 86.5, 149.2, 274, 281.1, 280/304.1, 304.4, 304.5
See application file for complete search history.

(56) References Cited

U.S. PATENT DOCUMENTS 3,643,996 A * 2/1972 Carnahan ..... 297/410
5,388,289 A * 2/1995 Casperson ..... 5/86.1
5,459,891 A * 10/1995 Reeve et al. ..... 5/87.1
5,490,687 A * 2/1996 Scholl ..... 280/250.1
6,976,278 B2 * 12/2005 Oetting et al. ..... 4/480

* cited by examiner

*Primary Examiner* — J. Allen Shriver, II
*Assistant Examiner* — Felicia L Brittman
(74) *Attorney, Agent, or Firm* — Anthony R. Lambert

(57) ABSTRACT

A wheelchair has a frame supported on wheels, a removable seat supported by the frame, a receptacle supported by the frame under the removable seat, a lifting tower supported by the frame and a sling carried by the lifting tower. The sling is operable by the lifting tower through a lifting range to move between positions in which a person carried in the sling is raised above the removable seat so that the removable seat may be removed and a person carried in the sling is lowered to be supported over the receptacle.

10 Claims, 23 Drawing Sheets

WHEELCHAIR WITH LIFT

CROSS-REFERENCE TO RELATED APPLICATIONS

This application claims the benefit under 35 USC 119(*e*) of U.S. provisional application Ser. No. 61/581,837 filed Dec. 30, 2011.

TECHNICAL FIELD

Wheelchairs.

BACKGROUND

The degree of disability of people who use wheelchairs varies considerably. For some of those who use wheelchairs being able to leave the wheelchair to deal with body functions is a relatively simple matter. For others, it is impossible. This invention provides a solution to the need for people who are wheelchair bound to be able to perform certain body functions with a relative degree of simplicity.

SUMMARY

In an embodiment, there is disclosed a wheelchair, comprising a frame supported on wheels, a removable seat supported by the frame, a receptacle supported by the frame under the removable seat, a lifting tower supported by the frame and a sling carried by the lifting tower; and the sling being operable by the lifting tower through a lifting range to move between positions in which a person carried in the sling is raised above the removable seat so that the removable seat may be removed and a person carried in the sling is lowered to be supported over the receptacle.

In various embodiments, there may be included any one or more of the following features: in the lowered position the person is supported by a toilet seat that is supported by the frame; the sling has at least a first supporting section and a second supporting section that are separated to be positionable respectively under the back and legs of the person; the sling is suspended from the lifting tower by cables; the lifting tower includes a part that extends upward above the frame of the wheelchair from the back of the frame; the lifting tower includes a lever arm that pivots on the part that extends upward above the frame, with a forward portion of the lever arm extending over the removable seat, and the sling being suspended from the forward portion of the lever arm; and a rearward portion of the lever arm is connected through a linear actuator to the frame. These and other aspects of the device are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
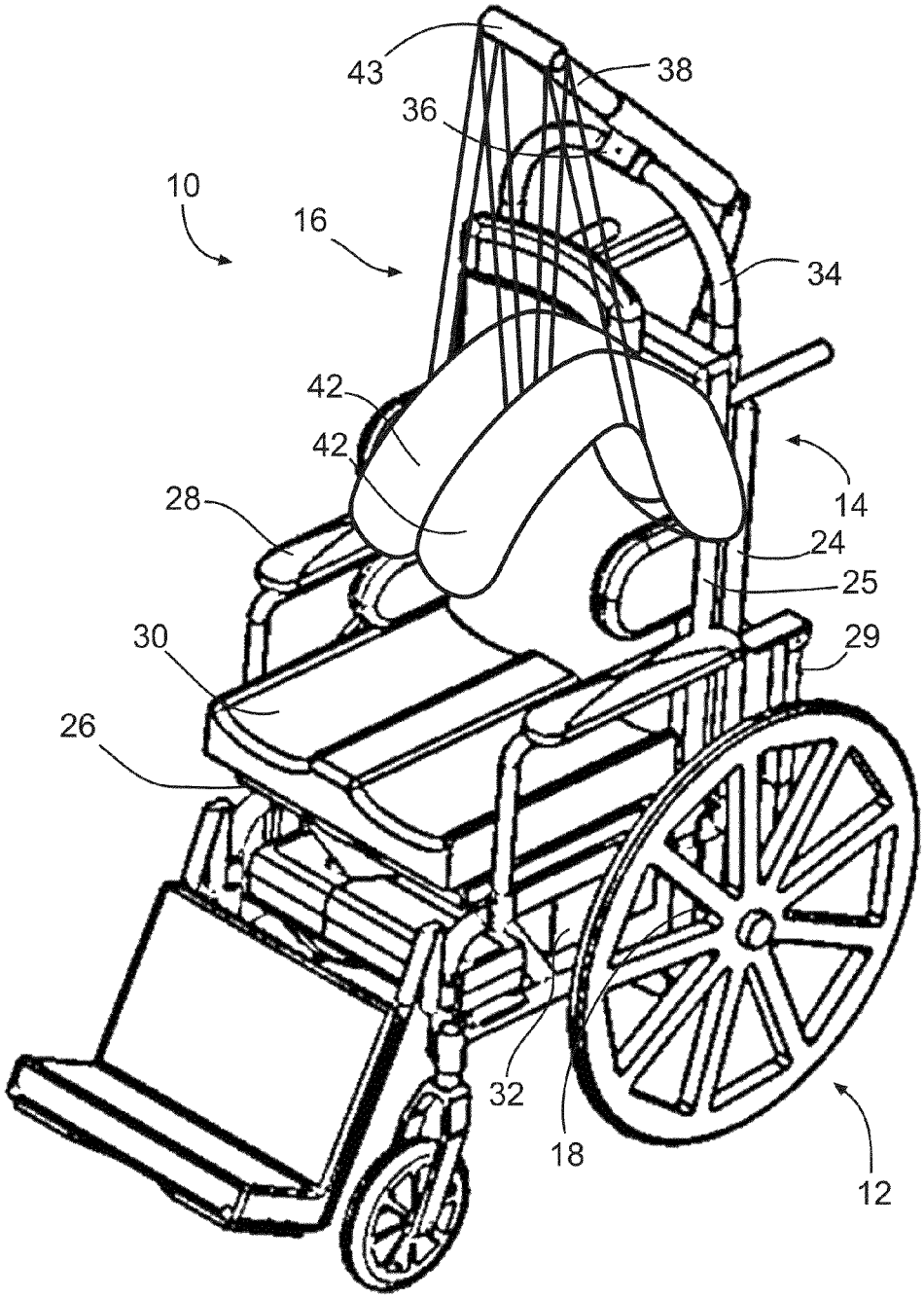
FIG. 1 shows a first perspective view of a first embodiment of a wheelchair with lift and removable seat in place.
Figure 2:
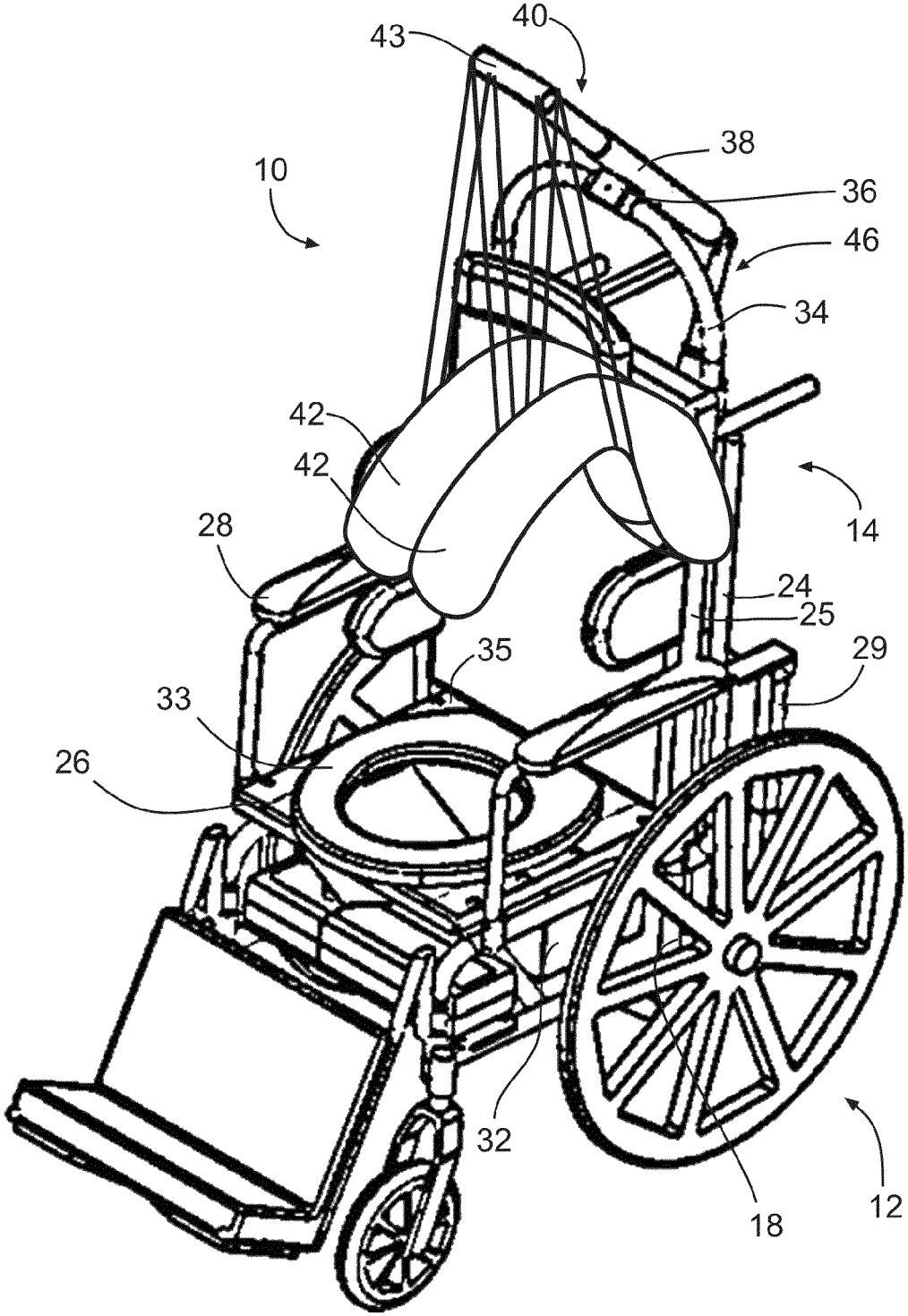
FIG. 2 shows a second perspective view of the first embodiment with removable seat removed.
Figure 3:
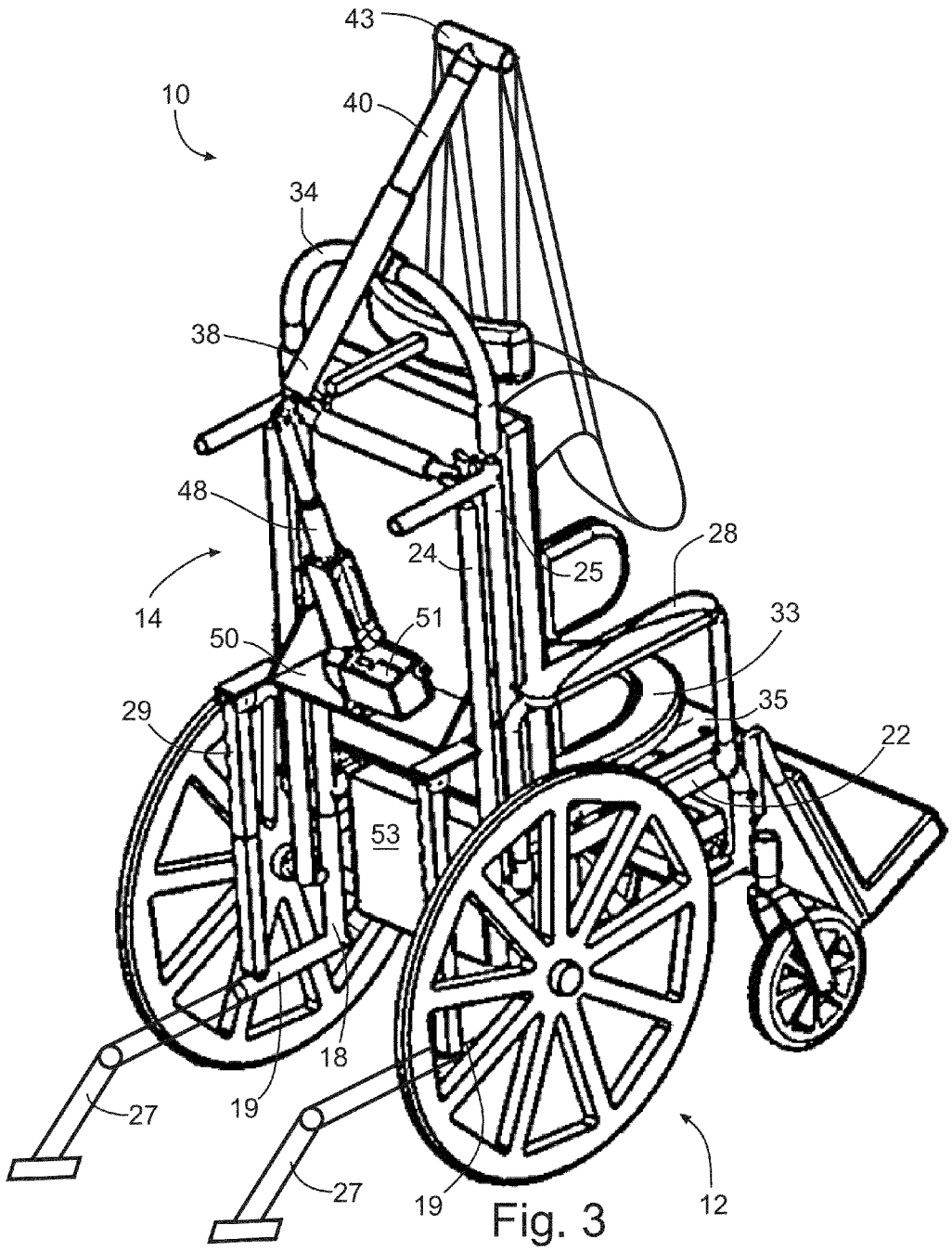
FIG. 3 shows a third perspective view of the first embodiment with removable seat removed.
Figure 4:
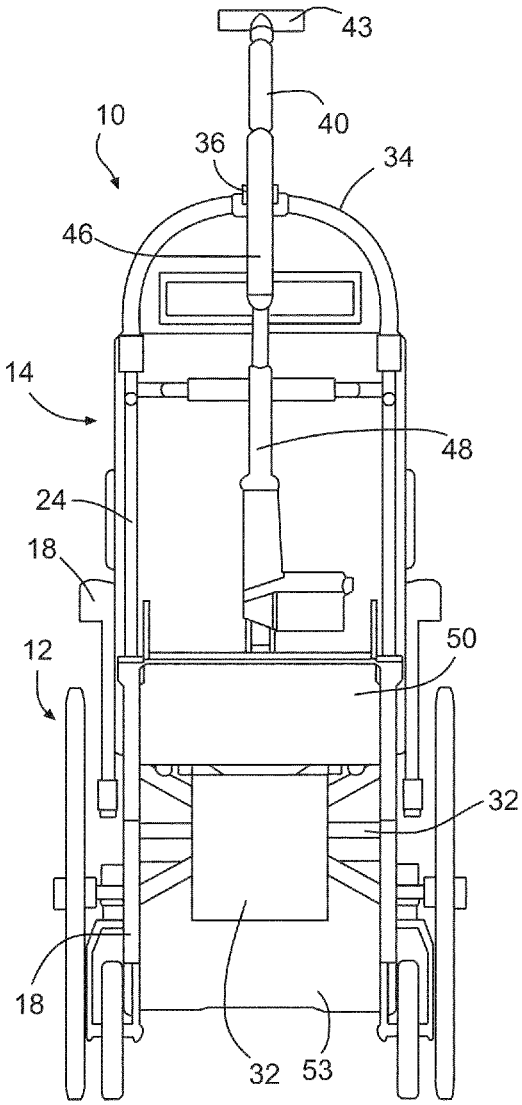
FIGS. 4 and 5 are respectively front and back views of the first embodiment of a wheelchair with lift.
Figure 5:
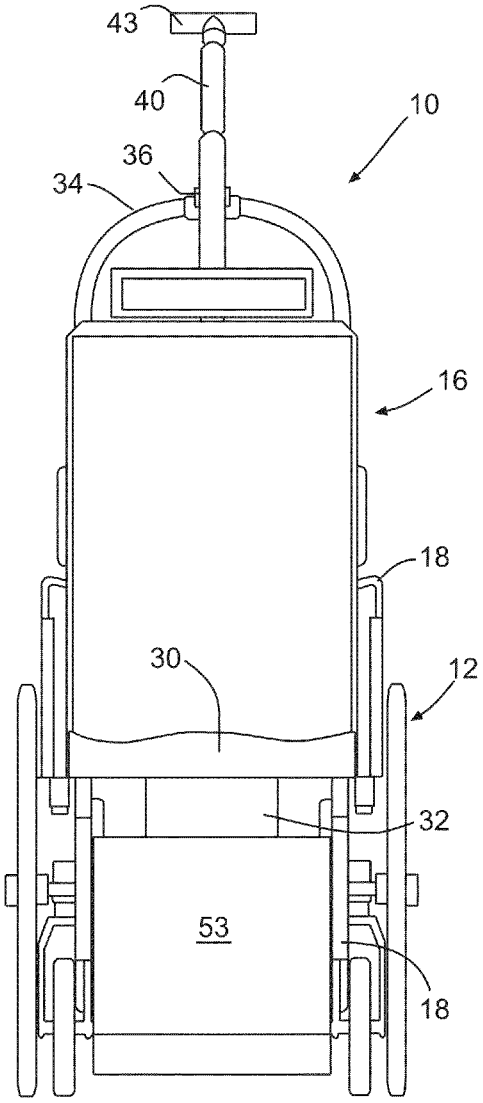

Referring to FIGS. 1-5, a wheelchair 10 has major structural components forming a frame supported on wheels 12. The frame has a back 14 and front 16. The wheelchair frame itself is mostly conventional and the design of the frame will vary between manufacturers. In many instances, the frame will include legs 18 to which the wheels 12 are attached, a seat supporting cage 26 from which the legs 18 depend, back supports 24, which extend upward from the rear of the seat supporting cage 26, and arm rests 28. A removable seat 30 is supported by the seat supporting cage 26. Wheelchairs are known that include removable seats. Under the removable seat 30, within the seat supporting cage 26, is a receptacle 32 for body waste that is supported by structural members forming the seat supporting cage 26.

A lifting tower 34 is supported by the frame. There are many ways to have a lifting tower supported by the frame. In an example shown, the lifting tower 34 includes a part 36 that extends upward above the frame of the wheelchair 10 from the back 14 of the frame, more specifically from posts 25 that may be secured to the back supports 24 in this example, and a lever arm 38 that pivots on the part 36, with a forward portion 40 of the lever arm 38 extending over the removable seat 30, and a sling 42 is suspended from the forward portion 40 of the lever arm 38. Components of the lifting tower 34 may be made easily removable for example by using quick release connections.

The forward portion 40 of the lever arm 38 may include a cross-bar 43 to assist in lateral stabilization of the sling 42. In this manner, the sling 42 is carried by the lifting tower 34. In the embodiment shown, the sling 42 is suspended from the lifting tower 34 by straps 44 or other suitable suspension element. A rearward portion 46 of the lever arm 38 is connected through a linear actuator 48 to the frame, which in this example includes a plate 50 secured to the frame in any convenient manner to which the linear actuator 48 is attached.

The plate 50 may be secured to the posts 25 and supported by support legs 29, that connect to rearward extensions 19 of the frame of the wheelchair 10. The linear actuator 48 may be any suitable linear actuator such as a pneumatic, hydraulic or electric linear actuator. The linear actuator 48 may be powered by a suitable motor 51 with control and power pack 53, which may be placed in any suitable location on the wheelchair 10 such as at the back 14 or one side of the frame.

For use during lifting of a person, stabilizer bars 27 may be secured to a suitable part of the frame such as rearward extensions 19 of the legs 18. When stabilizer bars are used on the rear of the wheelchair frame, it is preferable that the brakes for the wheelchair be on the front wheels.

Figure 6:
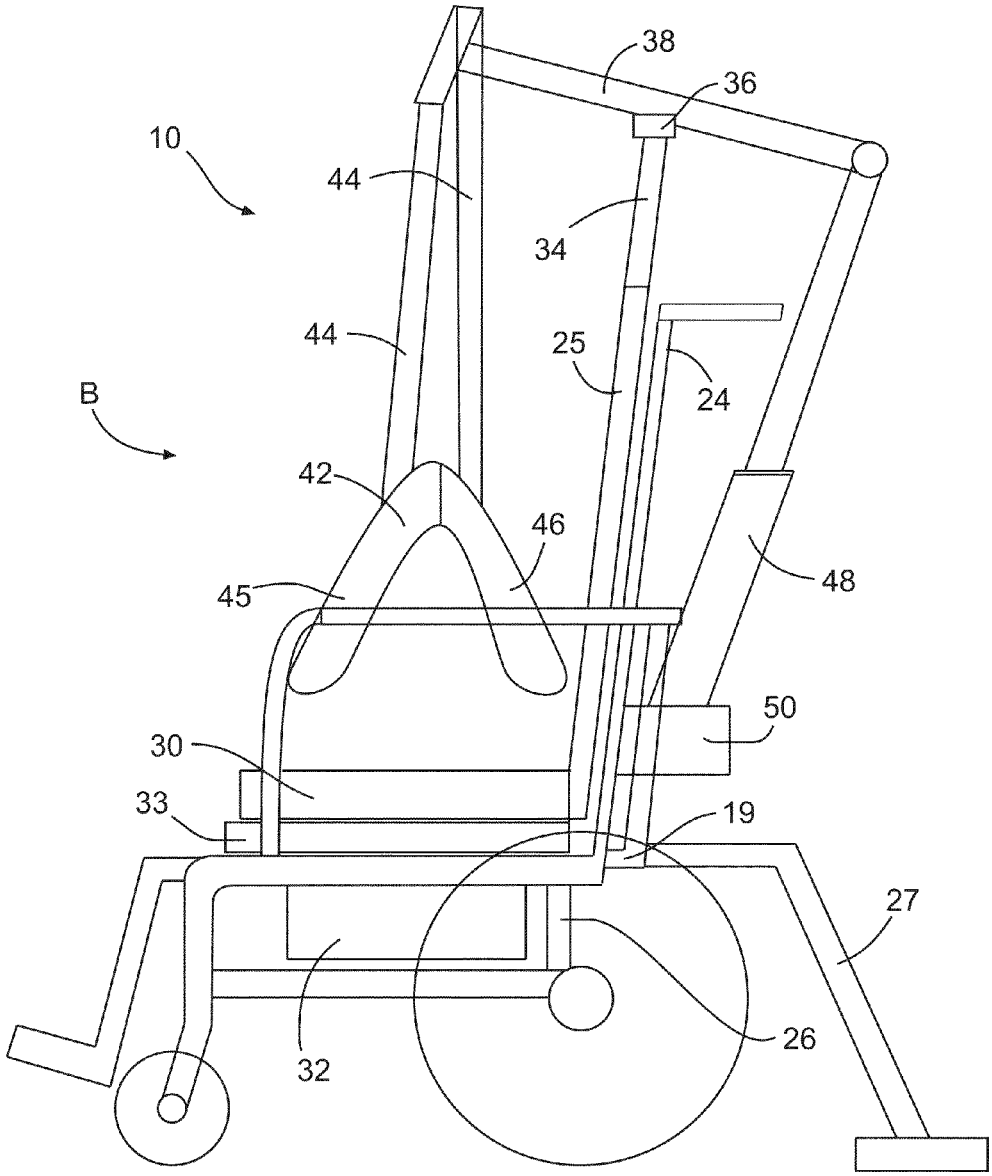
FIGS. 6, 7 and 7A are side views of the first embodiment showing respectively the lifting mechanism and sling in a first lowered position, raised position and a second lowered position.
Figure 7:
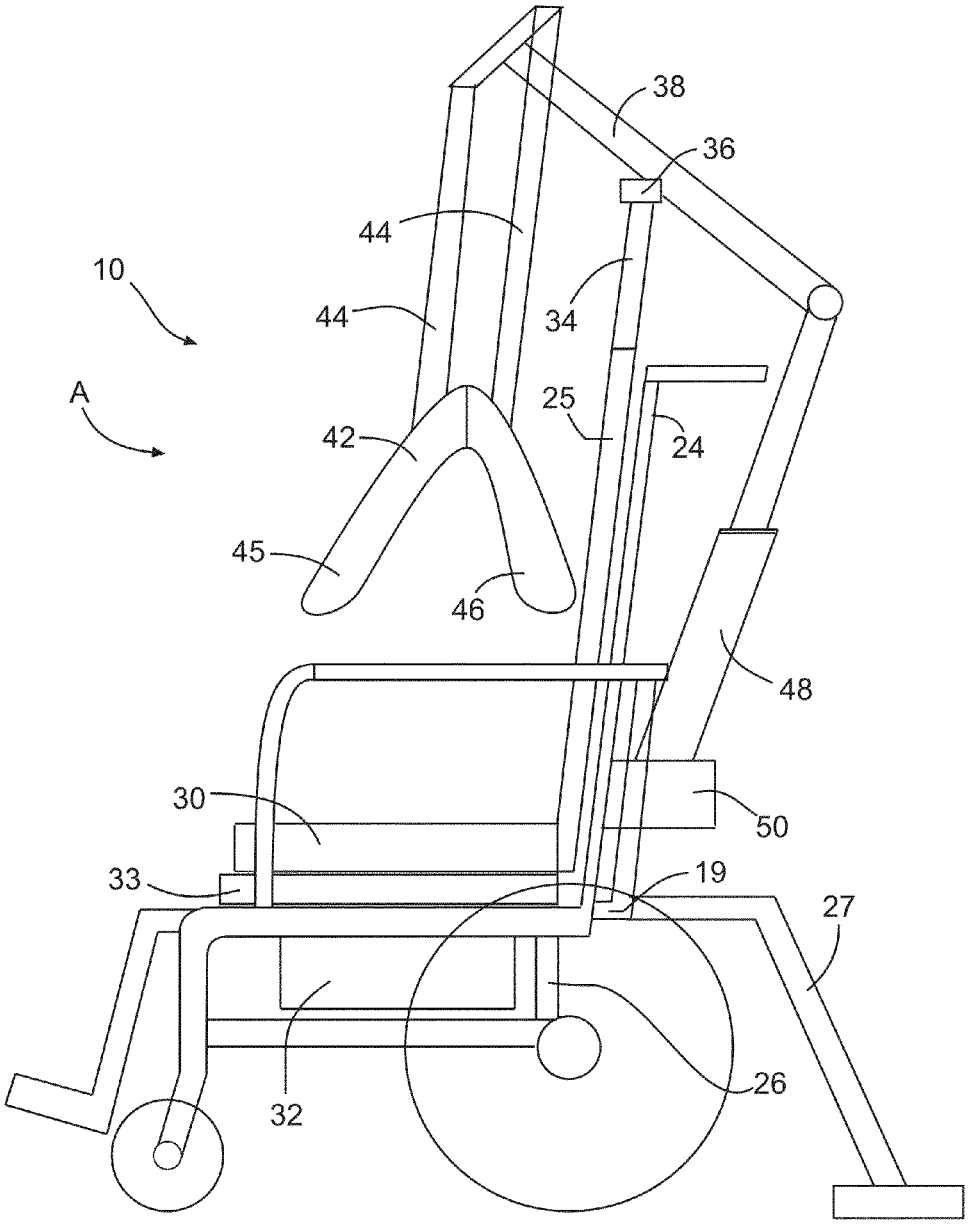
Figure 7A:
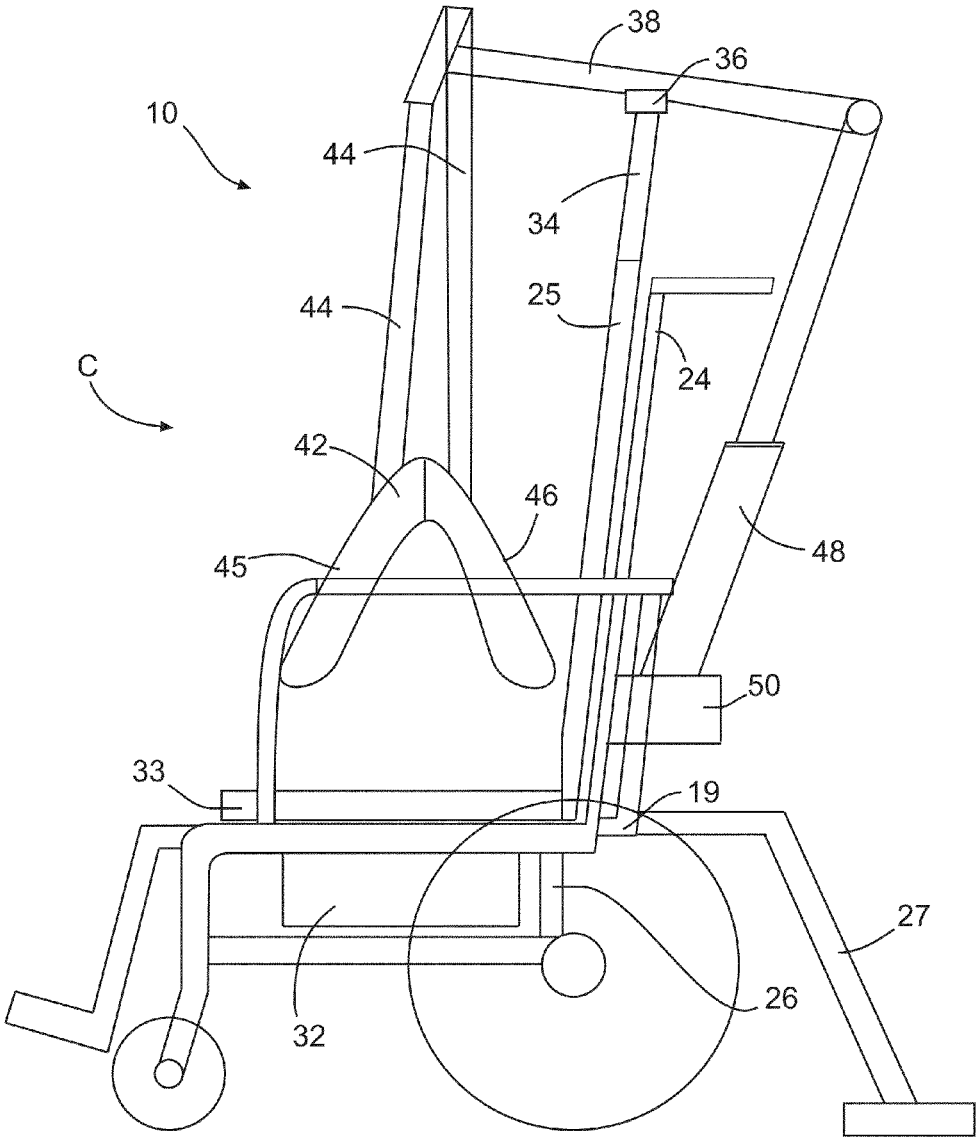

As shown in FIGS. 6, 7 and 7A, by actuation of the linear actuator 48, the lever arm 38 may be made to pivot on the part 36 and raise and lower the sling 42 between positions A (raised), B (intermediate position) and C (fully lowered). In the intermediate position B shown in FIG. 6, the person is sitting in the sling 42 but supported by the seat 30. This is the initial position. The sling 42 is thus operable by the lifting tower 34 through a lifting range to move between position A in which a person carried in the sling 42 is lifted above the removable seat 30 so that the removable seat 30 may be removed and position C in which a person carried in the sling 42 is supported over the receptacle 32. The position C may also correspond to a position in which the person is supported by a toilet seat 33 mounted on a support plate 35 over the receptacle 32. The support plate 35 may rest on and be secured to the cage 26, and may replace the conventional support such as a sling formerly used to hold up the removable seat 30. The receptacle 32 may be attached directly to the support plate 35. Modifications may be made to the removable seat 30 to make it more comfortable, such as by adding more support to the seat. Various slings may be used for the sling 42. In one embodiment, a sling 42 is used that has at least a first supporting section 45 and a second supporting section 46 that are separated to be positionable respectively under the back and legs of the person.

Figure 8:
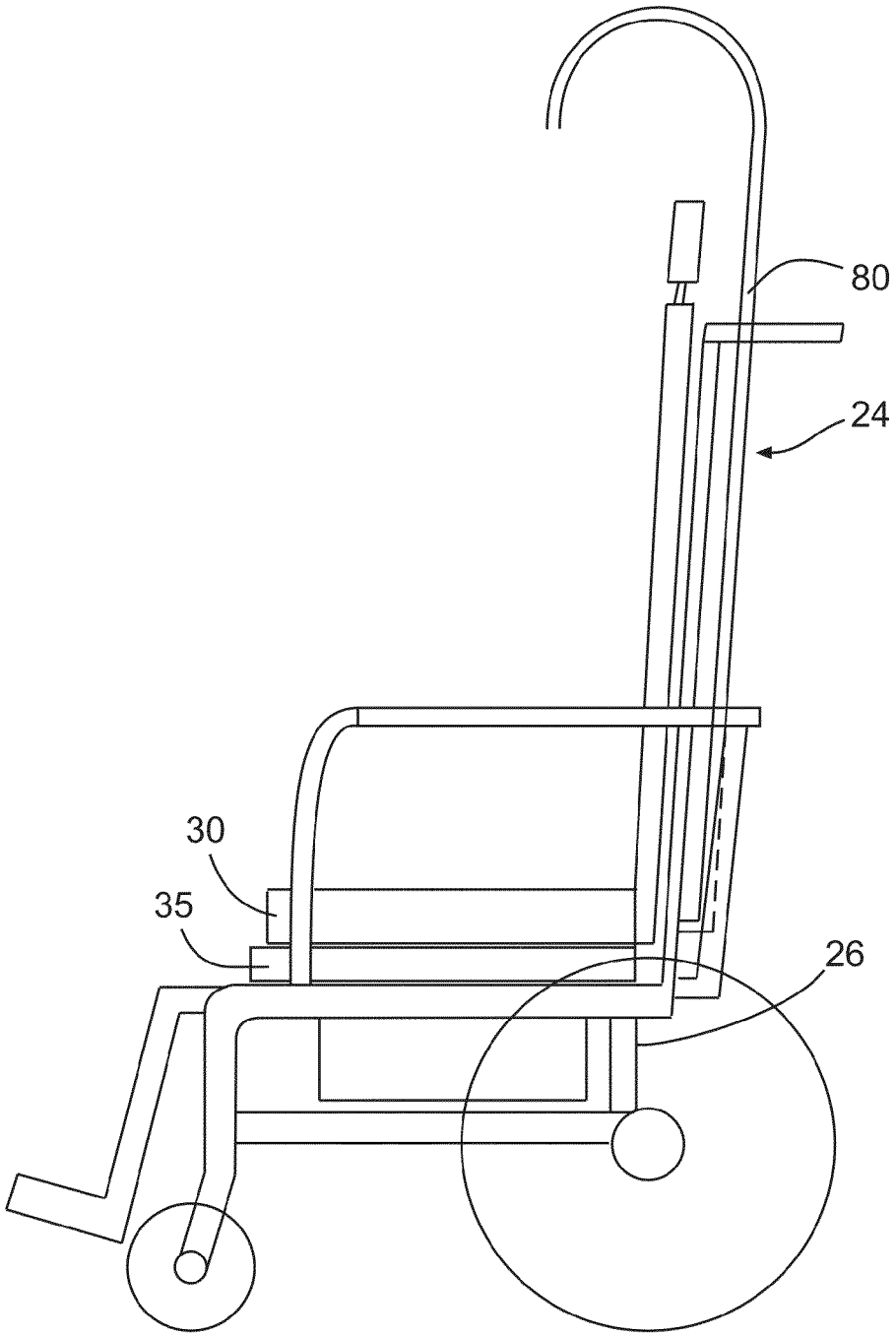
FIGS. 8, 9 and 10 are side views of further embodiments of a wheelchair with lift.

FIG. 8 shows a further embodiment of a lifting tower. In this example, lifting tower 80 comprises a hollow tube or track on which a chain or cable (not shown) travels. The lifting tower 80 in this instance is secured to the back 14 of the frame, for example to the back supports 24 and receptacle support cage 26. A motor (not shown) drives the chain or cable to raise or lower a sling (not shown) between the positions A, B and C. Controls and power for the motor for any of the disclosed embodiments may be located in any suitable position such as under the seat, in front of, at the back of or beside the receptacle.

Figure 9:
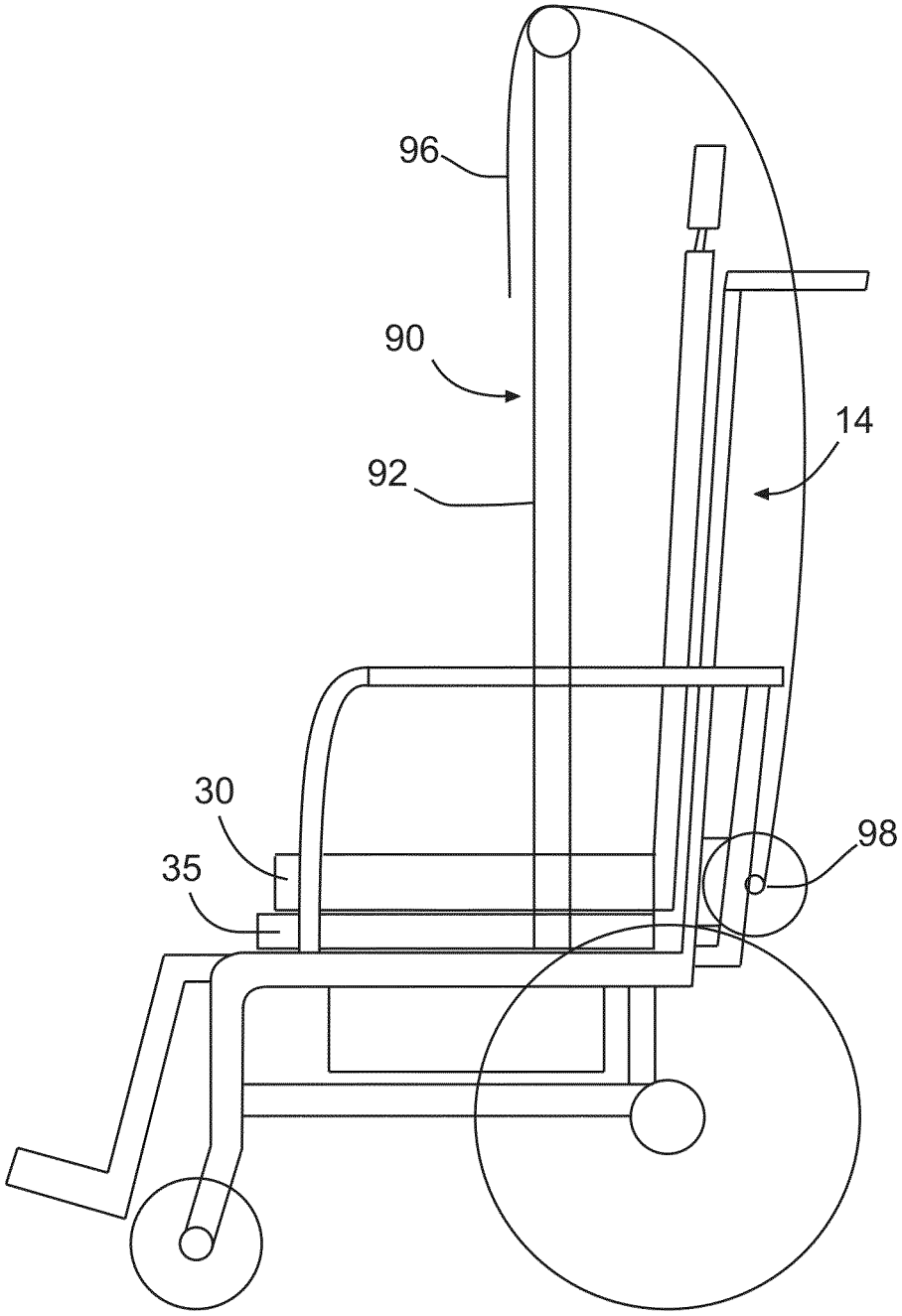
Figure 11:
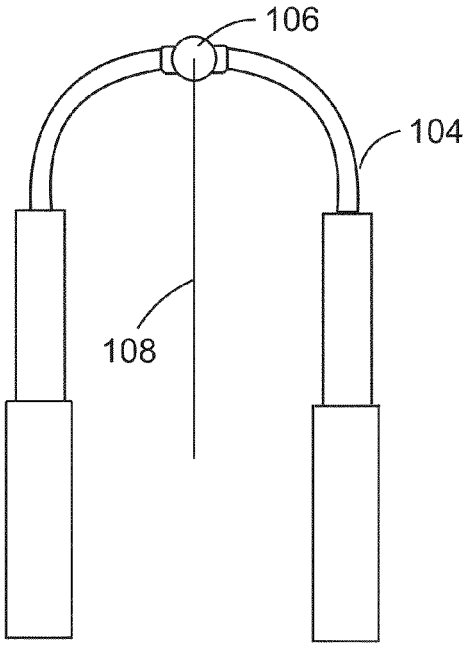
FIG. 11 is a front view of portion of a lift of the embodiment of FIG. 10.

FIG. 9 shows a further embodiment of a lifting tower. In this example, lifting tower 90 comprises a pair of posts 92 connected by a beam 94 across an upper portion of the posts 92. A chain or cable 96 extends from a winch 98 secured to the back 14 of the frame. The winch 98 drives the chain or cable 96 to raise or lower a sling (not shown).

Figure 10:
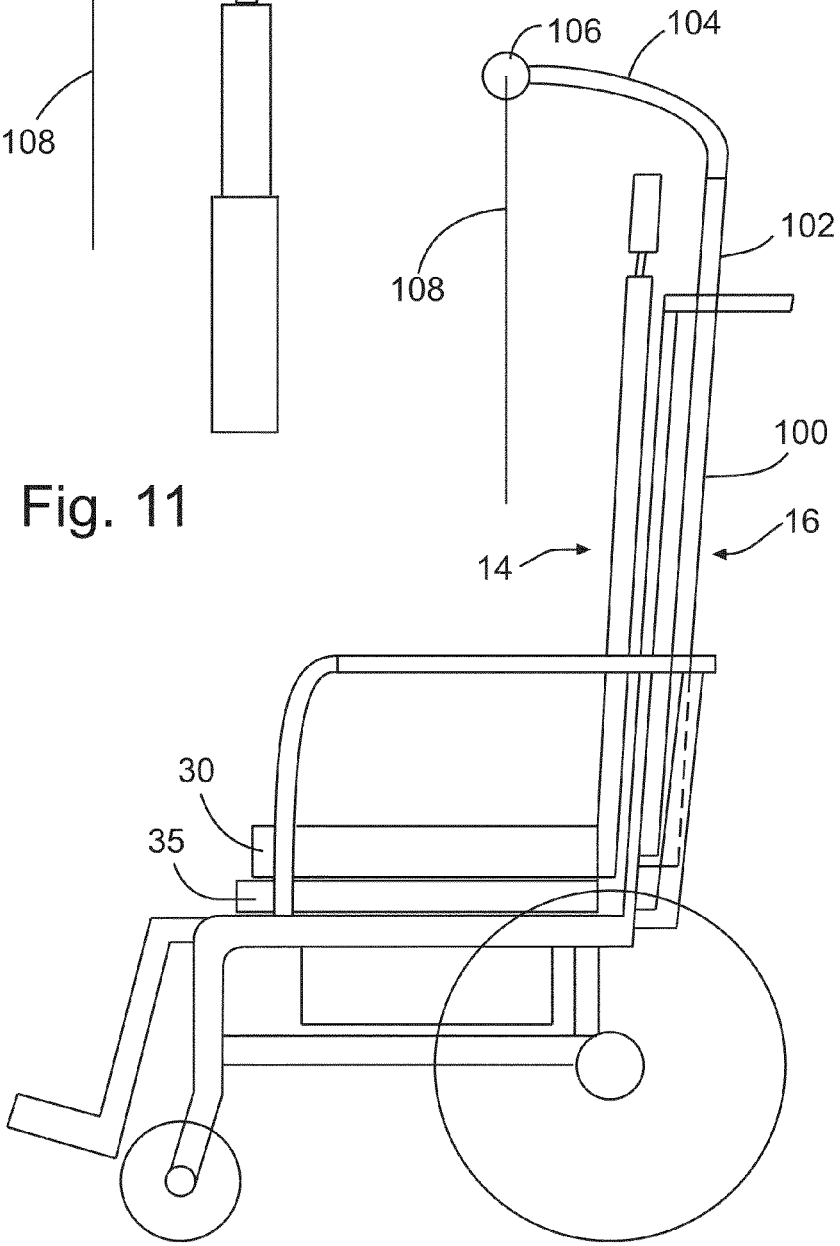

FIG. 10 shows a further embodiment of a lifting tower. In this example, lifting tower 100 comprises a pair of vertically standing actuators 102, such as hydraulic rams, and a pair of converging arcuate beams 104 that converge to meet at a connection 106. A sling (not shown) may be suspended from the connection 106 by any suitable means such as a chain or cable 108. The chain or cable 108 may be fixed to the connection 106 in this example. The rams 102 forming the lifting tower 100 in this instance may be secured to the back 14 of the frame and the cage 26 or may be secured to the sides of the frame, between the back 14 and front 16.

In each of the examples of FIGS. 8, 9 and 10, lowering of the sling may be accomplished by a controlled descent under gravity, while raising of the sling is powered.

The lift or lifting tower shown in FIGS. 1-7 works well, and accommodates a reclining chair, by angling of the back arms to allow the chair to continue to be reclined to 45 degrees. The lift itself does not use or depend on any recline. For safety reasons, the lift should not be used in a reclining position and in the case of a reclining chair it is recommend to use a locking mechanism in place to prevent this.

The toilet seat 33 is preferably concealed below the removable seat 30 or cushion, and fitted to the size of the person expected to use the wheelchair 10.

The receptacle 32 functions as a commode pot or bedpan. The size and shape of the receptacle is dictated by the structure of the cage 26, which varies from wheelchair to wheelchair. For example, the receptacle 32 may need to be shaped to accommodate cross-struts of a collapsible wheelchair.

The lifting sling may have a variety of designs. The design shown is a known sling for lifting a person that provides good upper back support. However, the leg slings do interfere somewhat with clothing adjustment for changing and toileting purposes when the individual is in the lift position. Therefore it is preferable to use under the knee supports attached directly to an upper part of the lifting tower (such as the lifting arm) and that moves in concert with the rest of the sling. Other options may be used for making the sling more accessible for dressing and undressing. For example, the second, under the knee part, piece of the sling might need to be fastened by two straps on either leg (back and front) to the sling belt to act as a counter weight and keep the belt from sliding into the rib cage.

The lifting tower 34 may be retrofitted to an existing wheelchair as disclosed, or built into a new wheelchair. In the retrofit case, the supports of the lifting tower 34 may be separate posts 25 as shown that are secured to the back supports 24 of the wheelchair by any suitable means. The lifting tower 34 should be rated for the intended use for example lifting up to 240 lbs. The particular wheelchair shown is an Invacare 9000xt wheelchair, but any suitable wheelchair may be used. Depending on the design of the wheelchair, the following general but detailed procedure may be carried out:

Preparation:

Facing the user, apply brakes.

Place sling around the user.

Walk to the rear of the chair, install stabilizer bars (if being used).

Install lifting tower, sling and actuator if not already installed, and check and correct any hazards, for example loose connections, sharp edges or components being in the way of the user.

Lifting and Commode Use:

Begin lifting the user. Once the user is raised high enough above the seat, remove the seat.

Lower the user on to toilet seat by operating the actuator with its control system.

Once the user has finished, raise the user to height below maximum to ensure there is still room to raise the user when the seat is replaced.

Remove an armrest if better access is needed.

Remove waste receptacle out, for example by sliding, and place on floor/ground.

Finish cleaning process, wipe down seat and plate if needed.

Replace seat, possibly raising the user higher than before, and secure seat to chair, if required, for example using Velcro straps.

Lower the user onto seat, remove sling, remove or move any components of the lifting tower that might be in the way.

Secure the user with seat back rest straps, if required by that user.

Remove and store any lifting tower components in the opposite order they were placed, if required.

Empty, clean and replace receptacle

Remove stabilizer bars (if being used)

Release brakes

Parts may be stored in a bag or on the chair at the discretion of the operator.

Parts should be cleaned and disinfected on a daily basis. Lifting tower, actuator, control box and batteries should receive weekly cleanings using a gentle antibiotic solution, unless otherwise needed.

The control should be provided with an emergency stop button. Depressing the button should only cause the actuator to stop moving but will not lower the user back to her seat.

Depending on the design of the wheelchair, there may be a high risk of the user lurching during regular use of the chair and frame. In such situations, it may be desirable not to leave the user alone in the wheelchair, there should be no sharp exposed edges that the user might press against, and in some situations, stabilizer bars may need to be in place when using the frame.

Depending on the design of the sling, it may be necessary to ensure that the seat is easily replaced after cleaning, and that the user is not raised to the maximum height in case she might slip through the sling. When ready to replace the seat, raise the user to near or at the maximum height and slide seat in. This procedure may need some experimentation before figuring out the optimum heights.

Other features that might be desirable: Use foam covers on sharp components of the lifting tower. Make cloth wrappings for foam covers to permanently hold them in place. Place hooks on chair to carry lifting frame when not in use. Make an insulating cover for the linear actuator, control box and battery to protect them from cold. Keep sling straps as short as possible. Stitch Velcro disks into seat.

Figure 12:
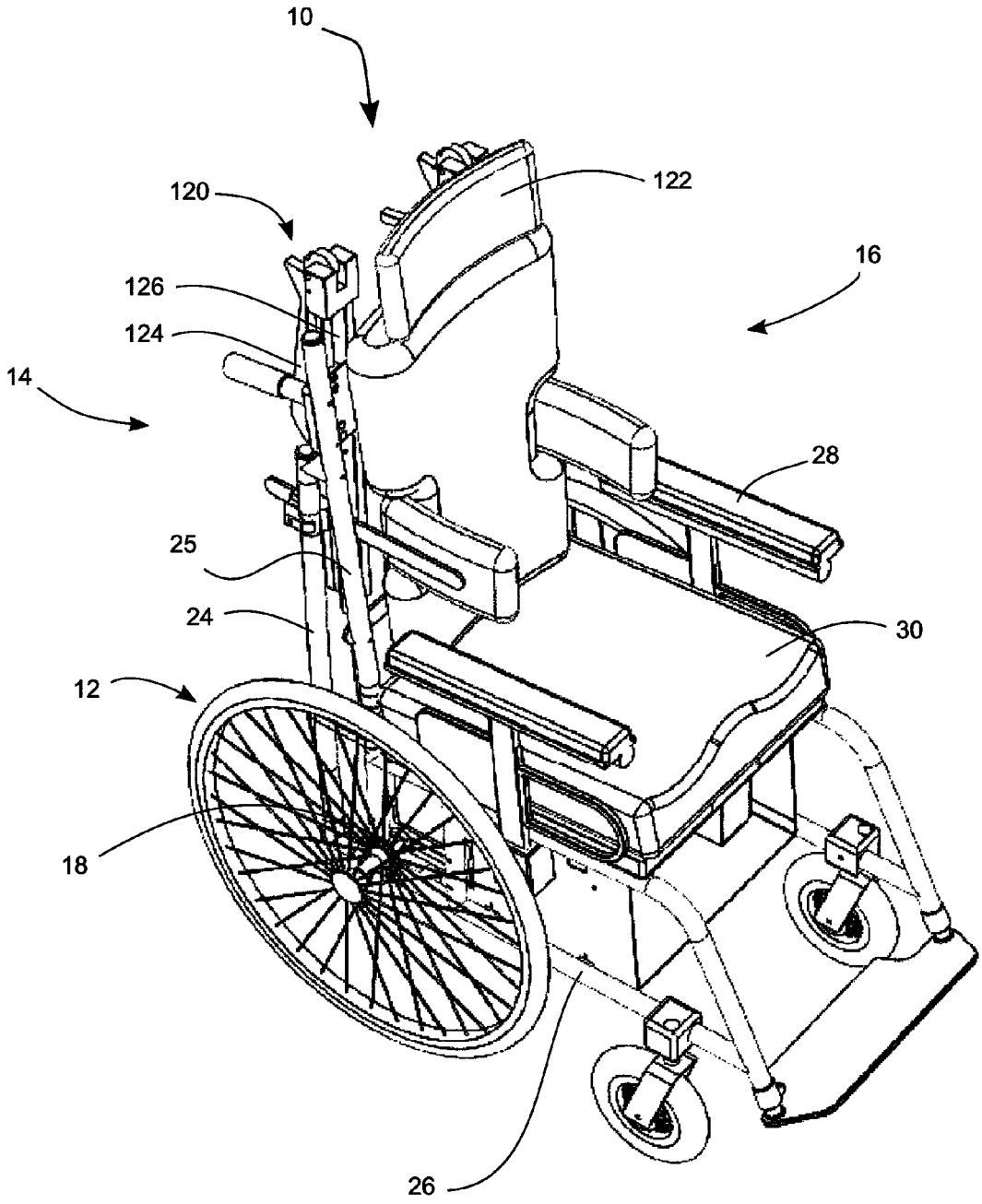
FIG. 12 is a first perspective view of a further embodiment of a wheelchair with lift, having lifting mechanism in standard configuration.

FIG. 12 shows a further embodiment of a wheelchair 10 having a back 14 and front 16. The wheelchair frame itself is mostly conventional and the design of the frame will vary between manufacturers. In many instances, the frame will include legs 18 to which the wheels 12 are attached, a seat supporting cage 26 from which the legs 18 depend, back supports 24, which extend upward from the rear of the seat supporting cage 26, and arm rests 28. The lifting tower 34 includes a sliding mechanism 128 that extends upward along the back 14 of the frame of the wheelchair 10 from the back 14 of the frame, more specifically from posts 25 that may be secured to the back supports 24 in this example. A removable seat is supported by the seat supporting cage 26. A suitable motor 51 supplies power to the linear actuator 128.

Figure 13:
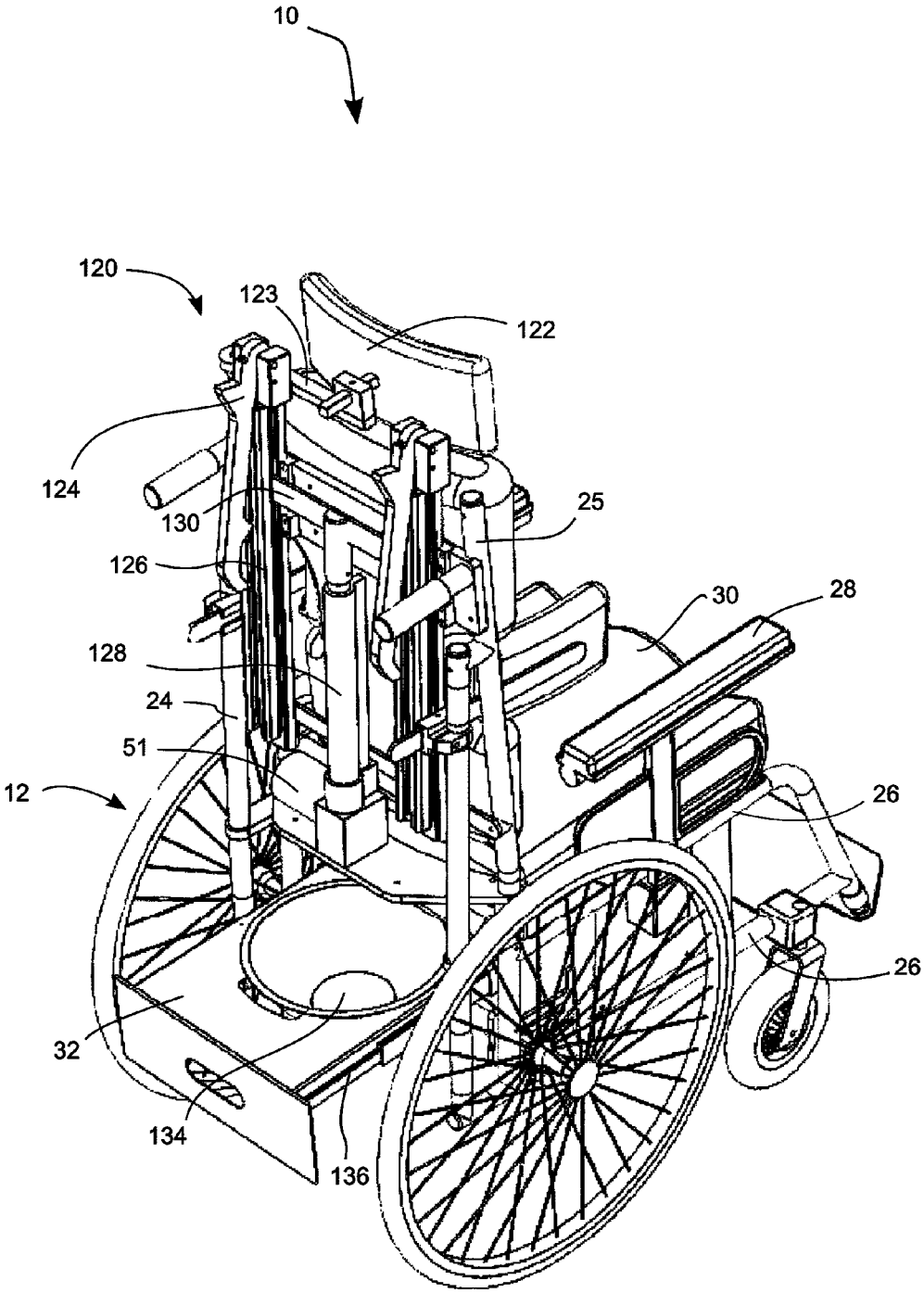
FIG. 13 is a second perspective view of the embodiment of FIG. 12 with receptacle removed from the seat supporting cage.

FIG. 13 shows the lifting tower 120, comprising a slide mechanism 126 and a linear actuator 128. In a preferred embodiment, the slide mechanism 126 may be separate from the linear actuator 128. The slide mechanism 126 supports paired hooks 124 which may be deployed forward to form a support from which a sling (not shown) may be suspended. In a preferred embodiment, the lifting tower 120 does not extend above the traveling configuration of the frame, allowing ease of storage and transportation of the wheelchair 10. The traveling configuration of the frame includes the parts of the frame that are not readily removable. In the embodiment shown in FIG. 13, the headrest is not a removable part of the frame. In this example wheelchair 10 is in standard configuration as in FIGS. 12 and 13, the lifting tower 120 is positioned at or below the height of the wheel chair frame. A crossbar 130 is shown connecting the linear actuator 128 to sliding mechanism 126 to allow the linear actuator 128 to act upon the slide mechanism 126. Headrest 122 is attached, for example by a horizontal support 123, to a vertical support of the frame such as post 25 allowing the headrest 122 to be removed by rotating the headrest about a vertical axis.

In a preferred embodiment, under the removable seat 30 within the seat supporting cage 26 is a receptacle 32 for body waste which comprises a bowl 134 and a removable drawer 136. In FIG. 13 the drawer 136 is deployed rearward for emptying. When the drawer 136 is deployed rearward for emptying, the bowl 134 may be accessible from the rear of the wheelchair 10, allowing the bowl 134 to be removed from the drawer and emptied.

Figure 14:
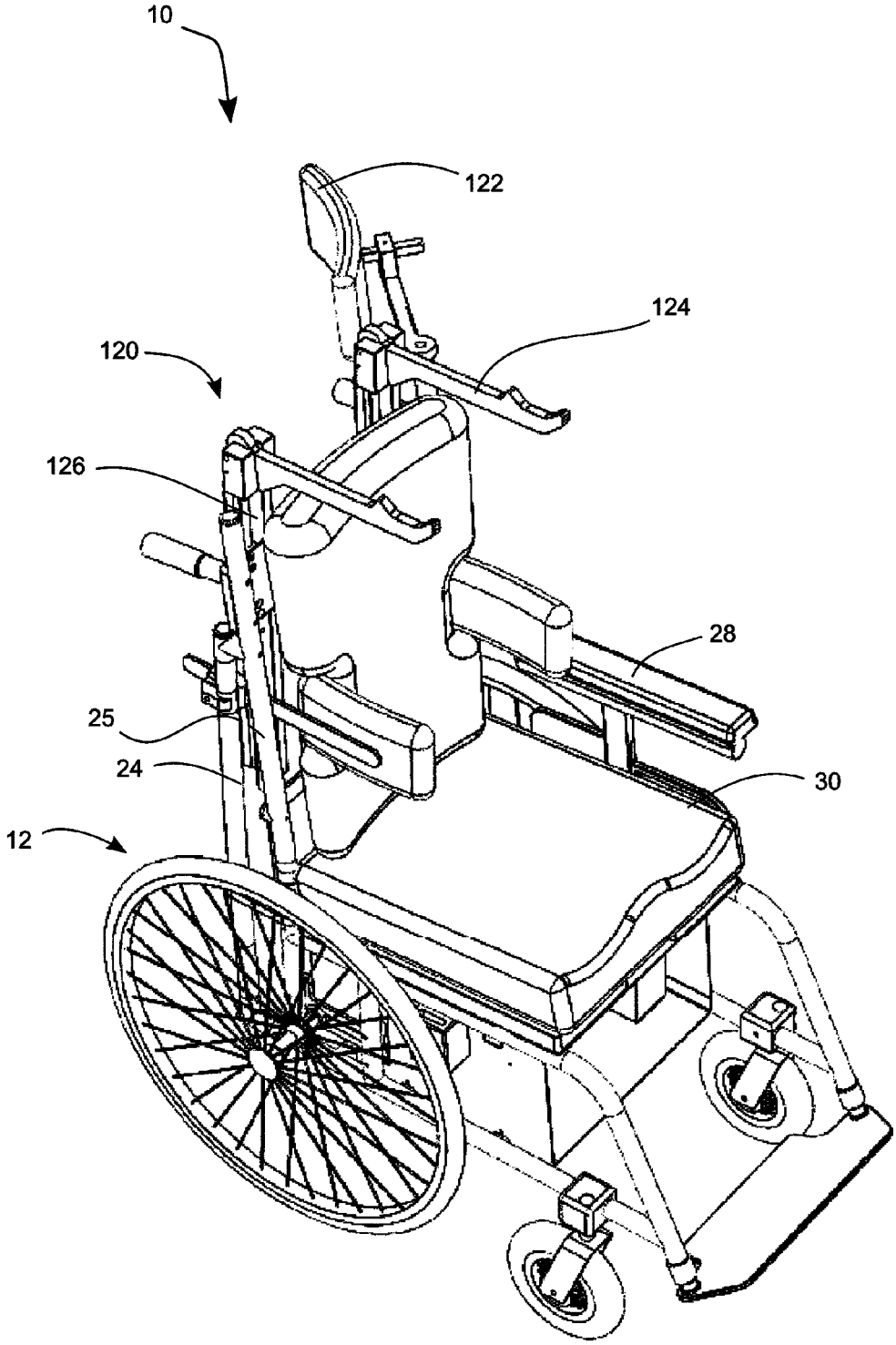
FIGS. 14, 15 and 16 are perspective views of the embodiment of FIG. 12 showing respectively the lifting mechanism in a lowered position, raised position, and raised position with seat removed.
Figure 15:
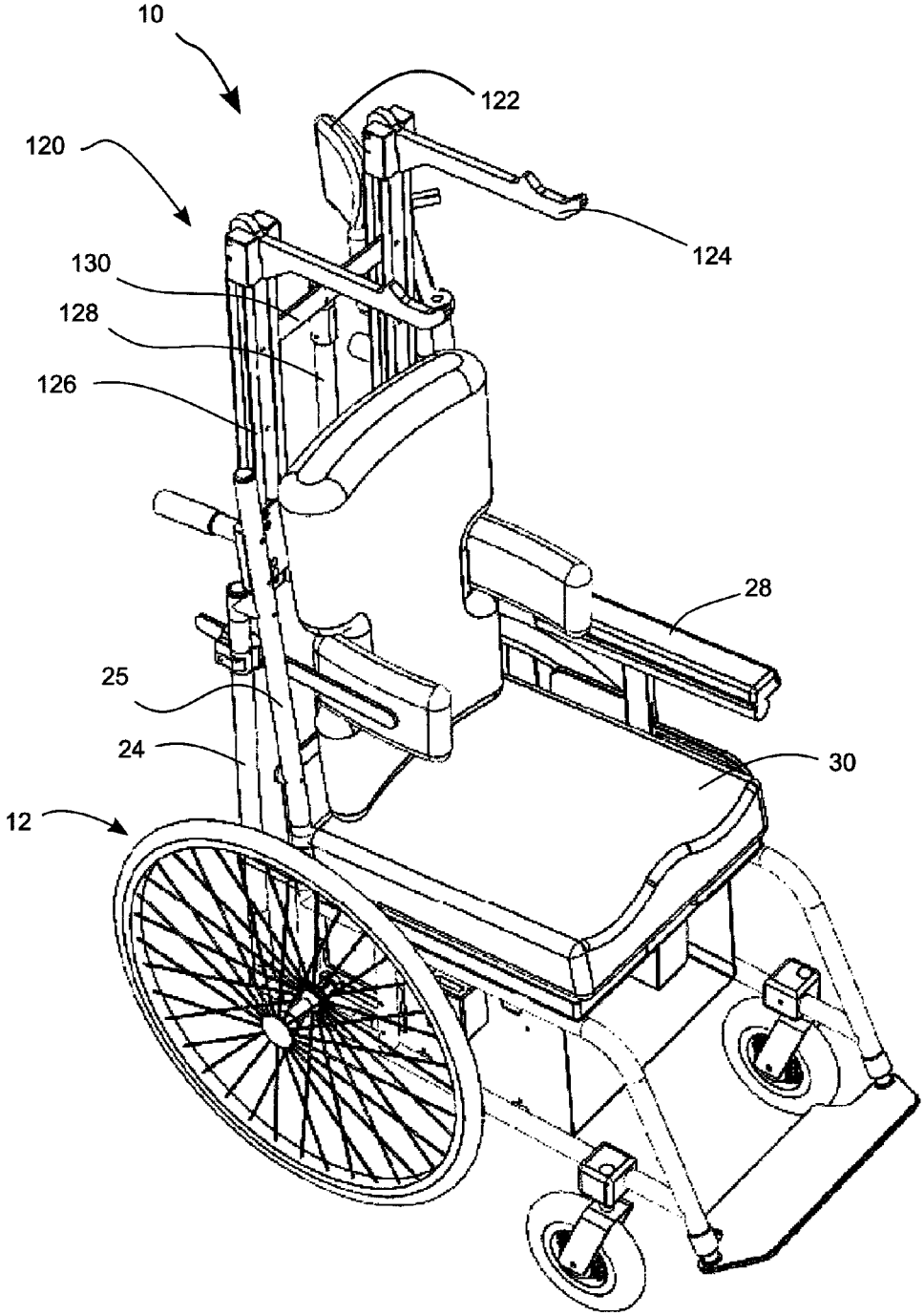
Figure 16:
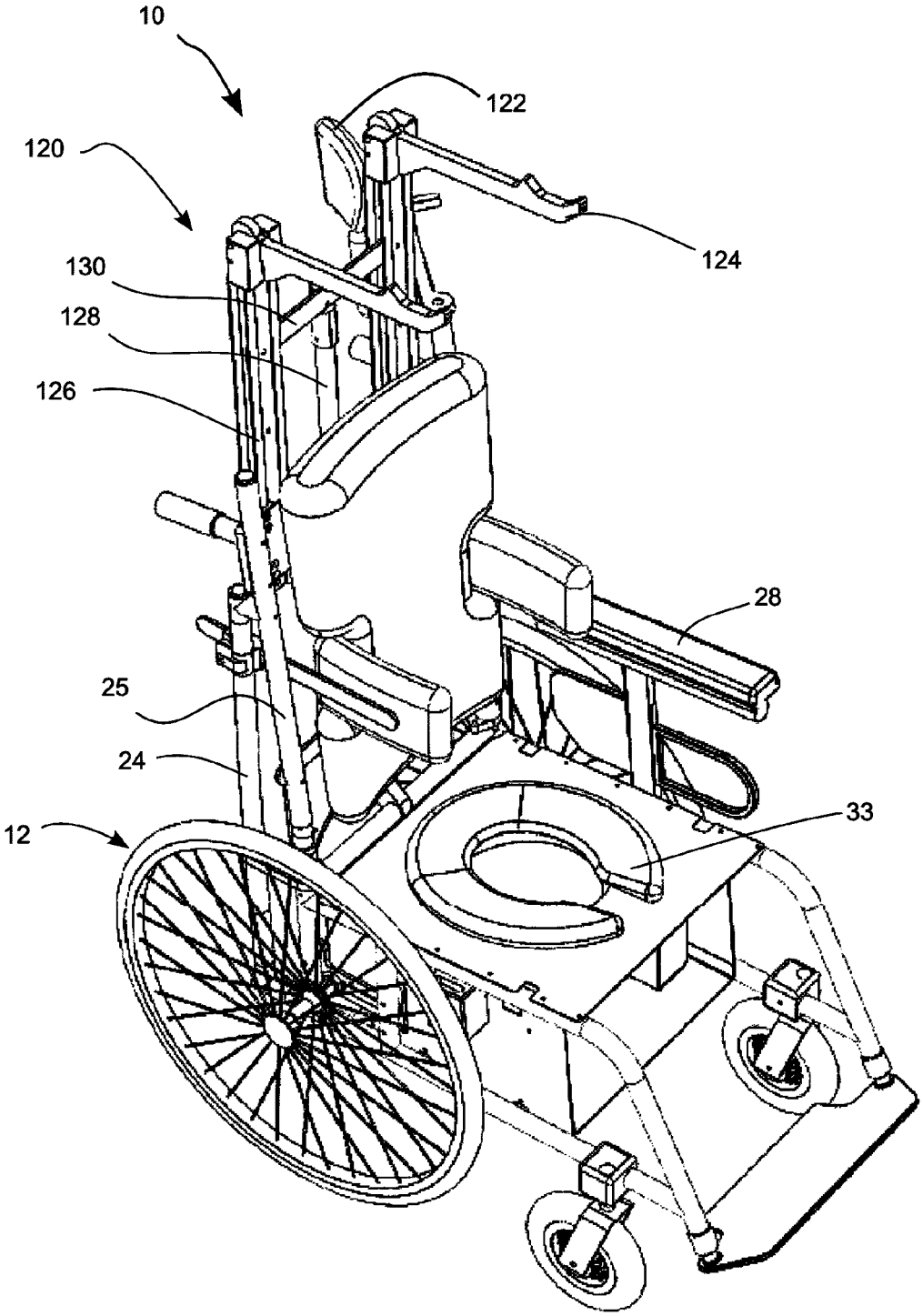
Figure 17:
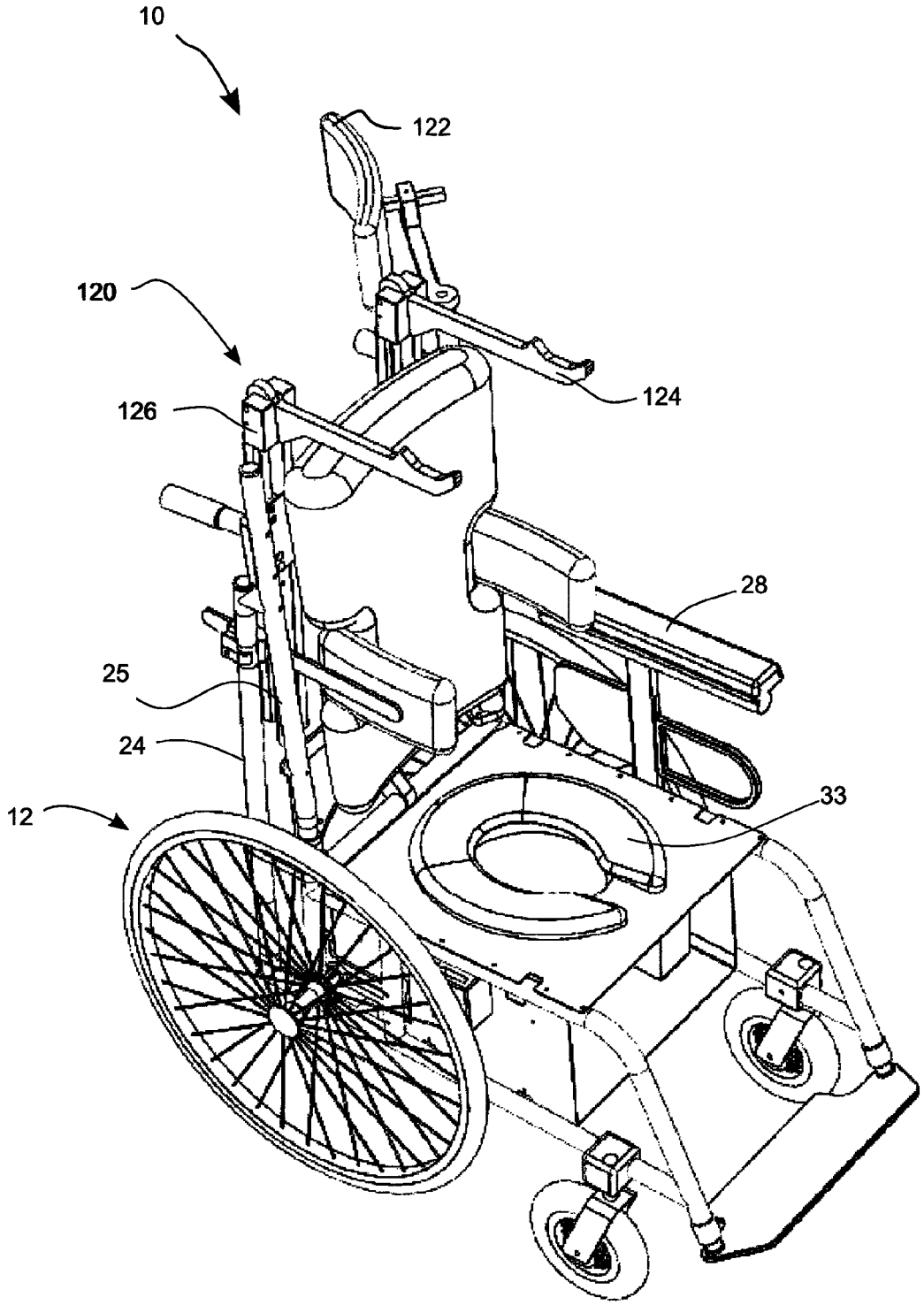
FIGS. 17, 18, 19 and 20 are perspective views of the embodiment of FIG. 12 showing respectively the lifting mechanism in a lowered position with seat removed, raised position, raised position with seat replaced, and lowered position.
Figure 18:
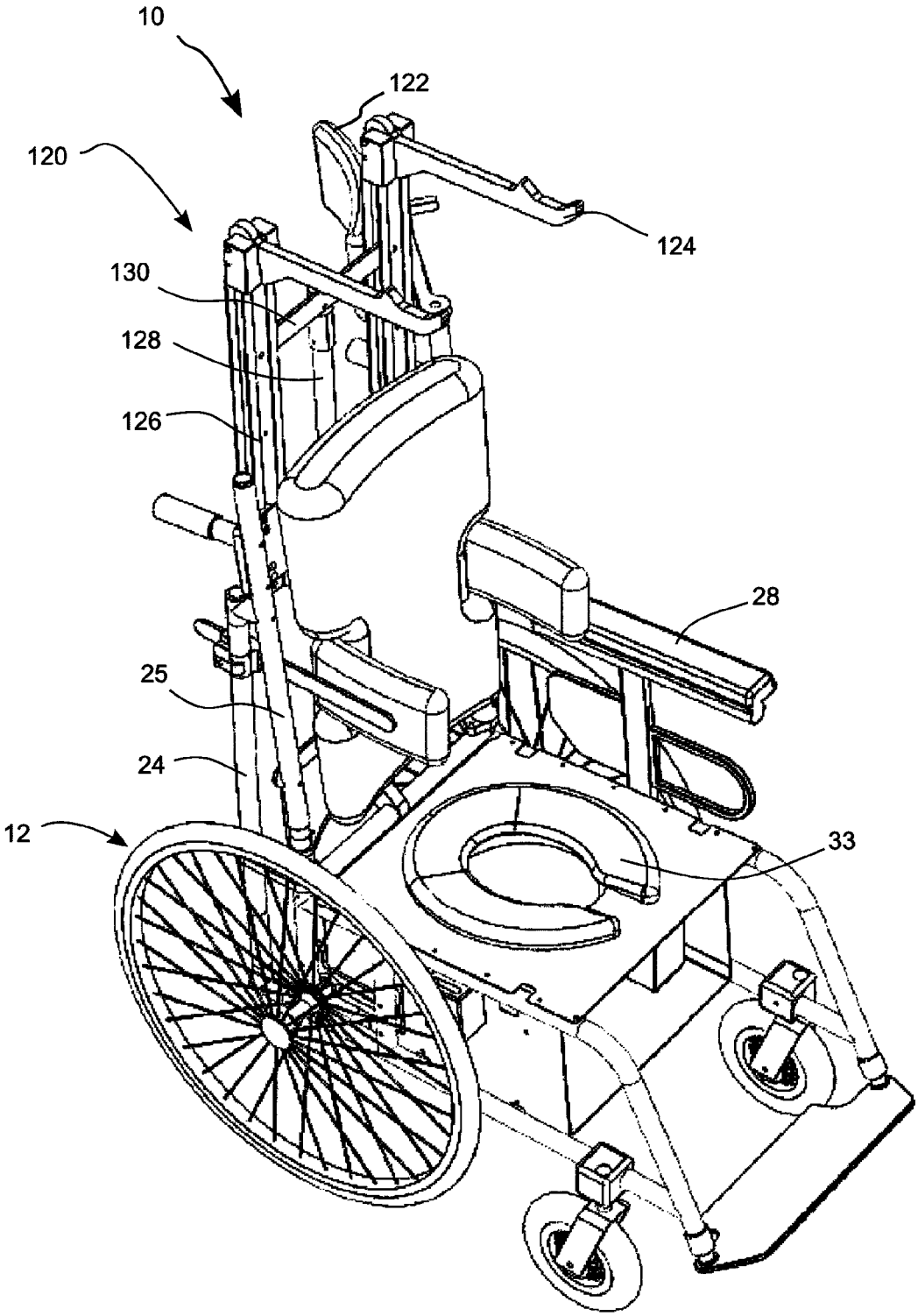
Figure 19:
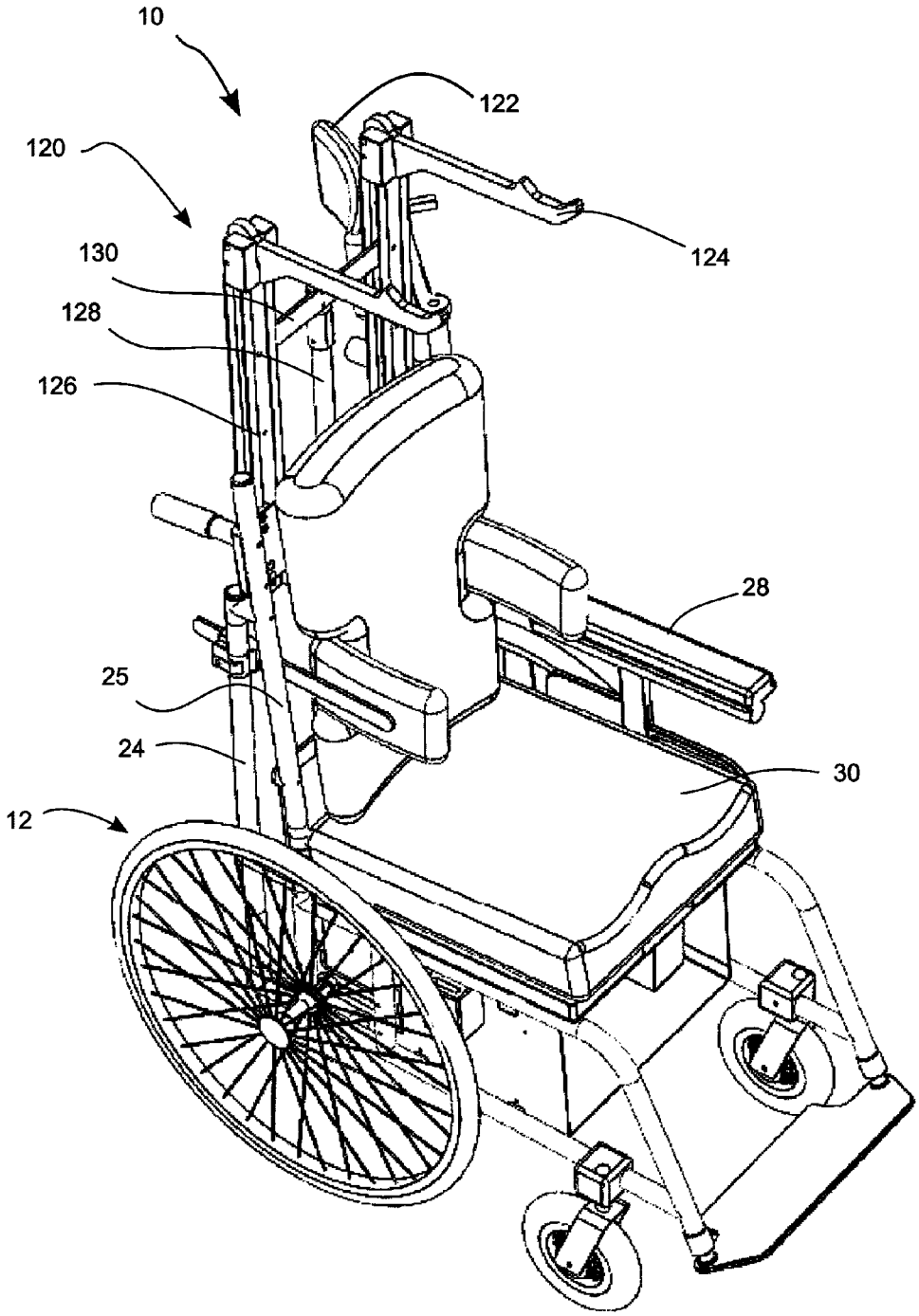
Figure 20:
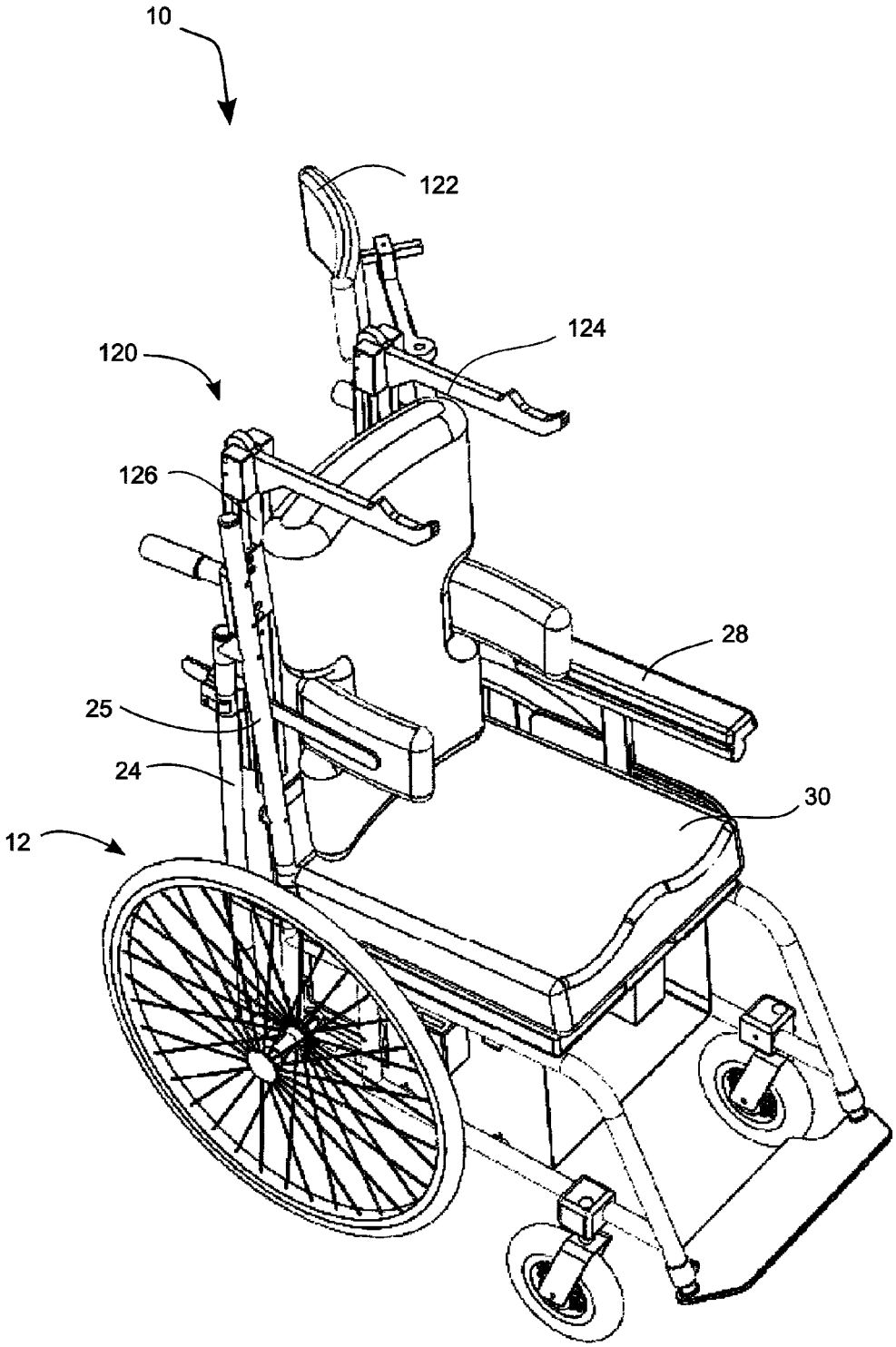

In FIGS. 14-20, a lifting procedure is shown. FIG. 14 shows the wheelchair 10 with the headrest 122 rotated out of the path of the hooks 124. Hooks 124 have been rotated upwards, so that the sling (not shown) may be supported by the hooks 124 and placed around the user. An armrest 28 has been removed to allow better access. FIG. 15 shows the wheelchair 10 after the linear actuator has acted upon the sliding mechanism to lift the hooks 124 and sling into a raised position, raising the user above the seat 30. FIG. 16 shows the wheelchair 10 after the seat 30 has been removed. FIG. 17 shows the wheelchair 10 after the lifting apparatus has been lowered to place the user on the toilet seat 33. FIG. 18 shows the wheelchair 10 when the user has been raised after the user has finished. FIG. 19 shows the wheelchair 10 with the seat replaced. FIG. 20 shows the wheelchair after the user has been lowered back onto the seat 30.

Figure 21:
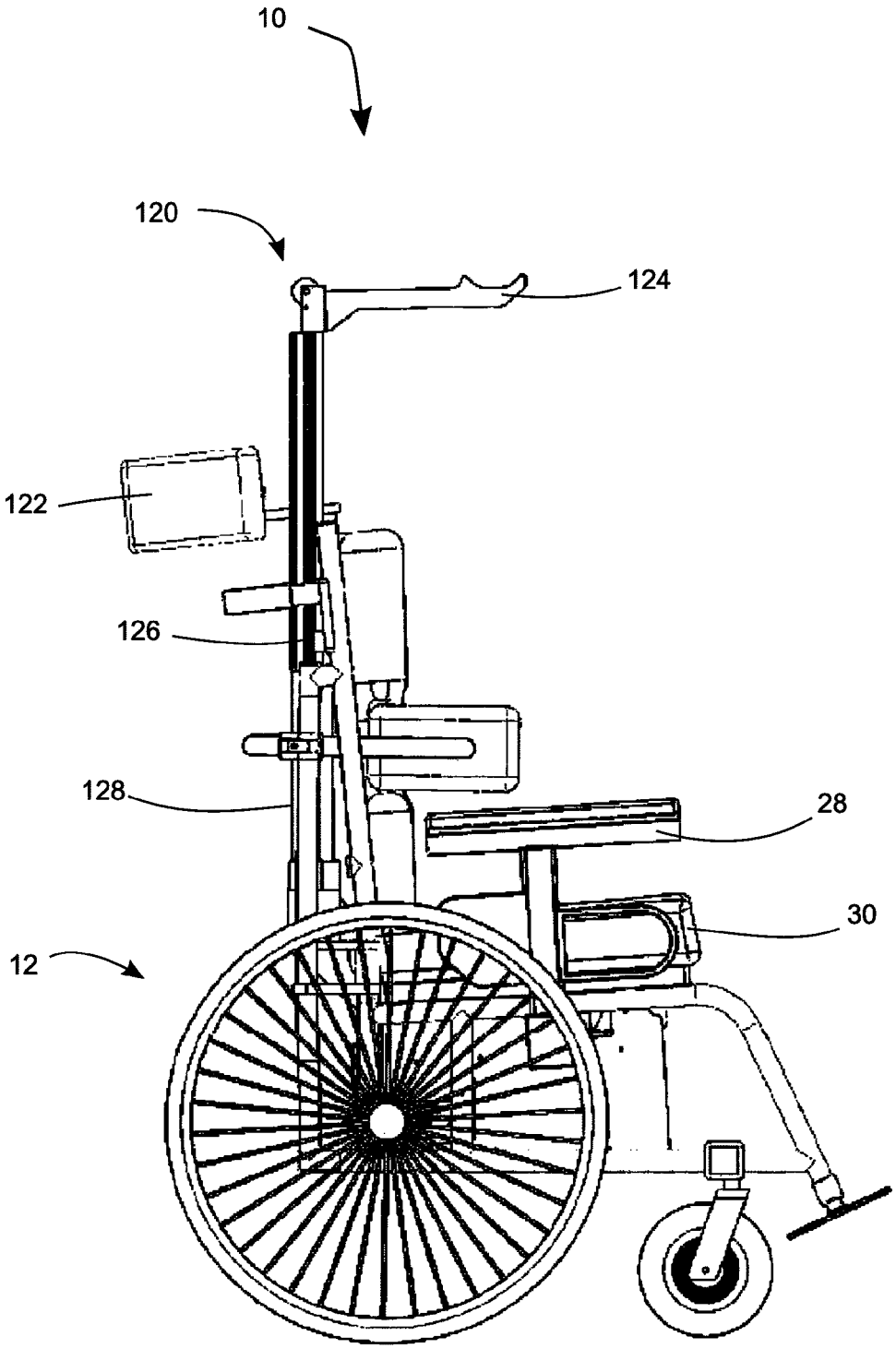
FIG. 21 shows a side view of the embodiment of FIG. 12 with the lifting mechanism in a raised position.

In FIG. 21 a side view of the embodiment of FIG. 12 is shown with the lifting apparatus in a raised position. Paired hooks 124 allow a sling (not shown) to be positioned directly on a user. Vertical sliding mechanism 126 allows the user to be lifted straight up and lowered straight down with minimal rubbing against the wheelchair 10.

Figure 22:
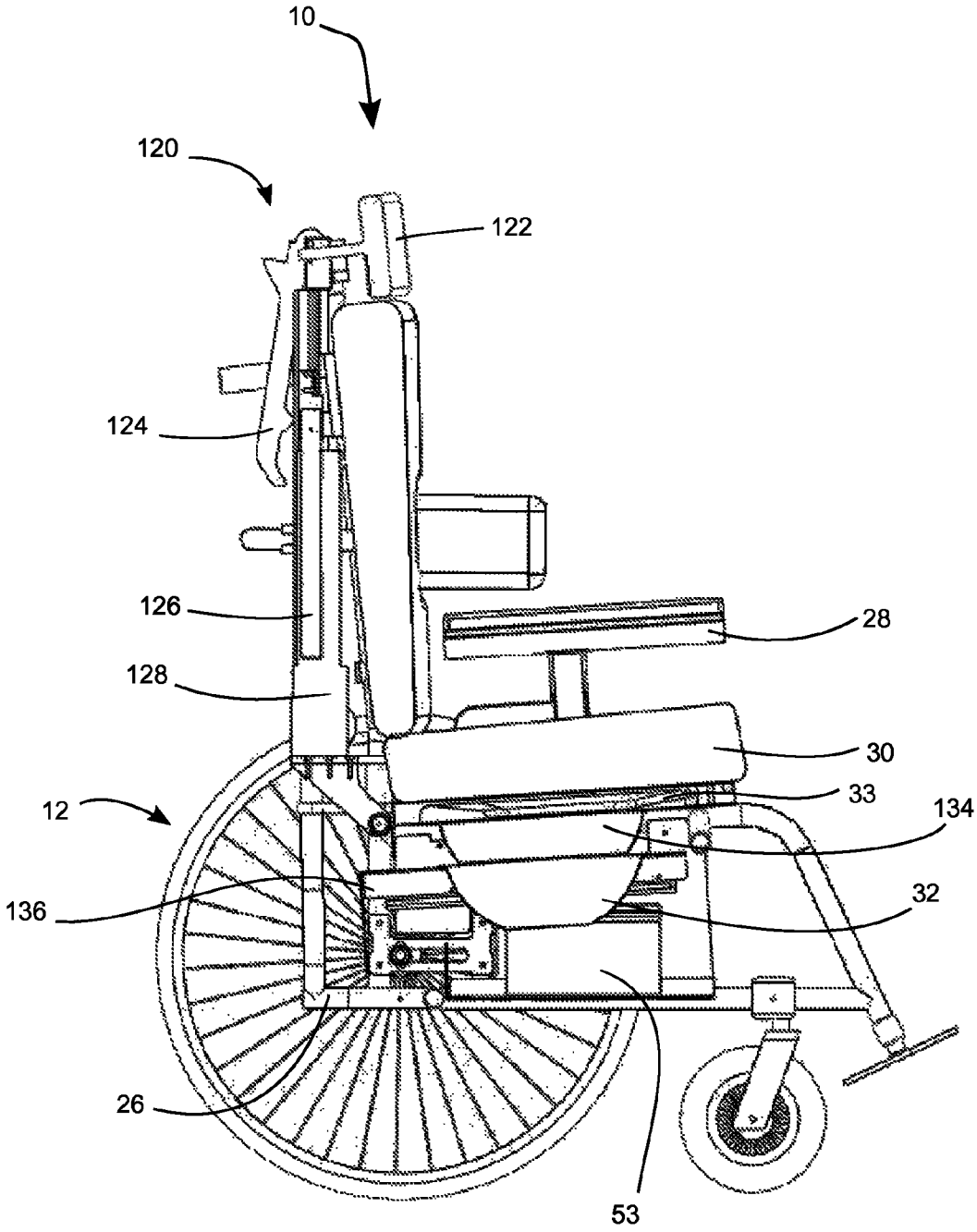
FIG. 22 shows a section view of the embodiment of FIG. 12.

FIG. 22 shows a cross section of the embodiment of FIG. 12 showing the toilet seat 33 under seat 30. Cowling 134 is positioned between the toilet seat 33 and above the receptacle 32 to prevent contamination of the surrounding area. A power pack 53 may be placed to either side of the frame of the wheelchair 10.

Figure 23:
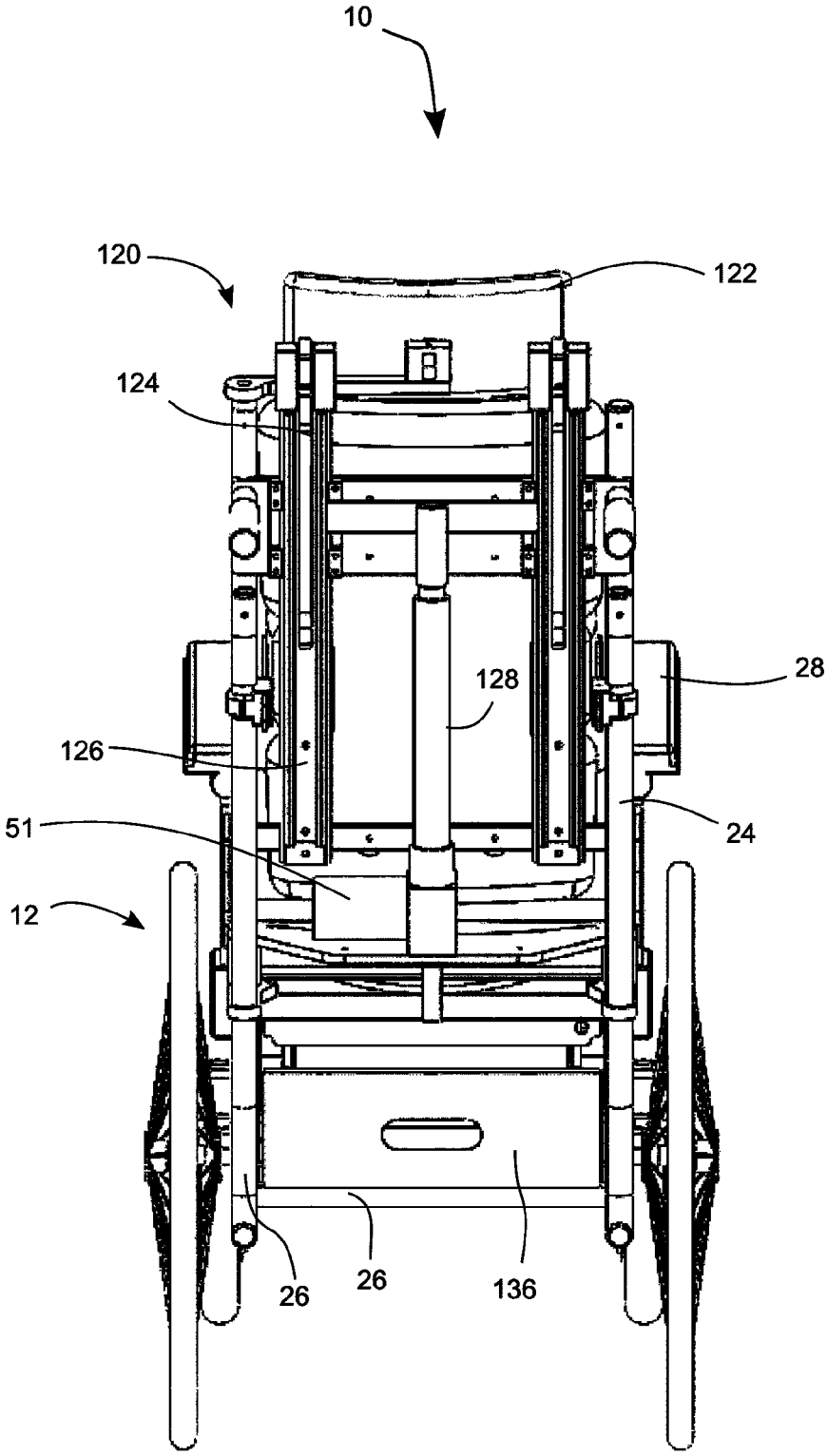
FIGS. 23 and 24 show rear views of the embodiment of FIG. 12 respectively in standard configuration and with the lifting mechanism in a raised position.

FIG. 23 shows a rear view of the embodiment of FIG. 12 in standard configuration. Dual hooks 124 are in a storage position. Slide mechanism 126 and linear actuator 128 are in a lowered position. Drawer 136 is stored inside seat supporting cage 26.

Figure 24:
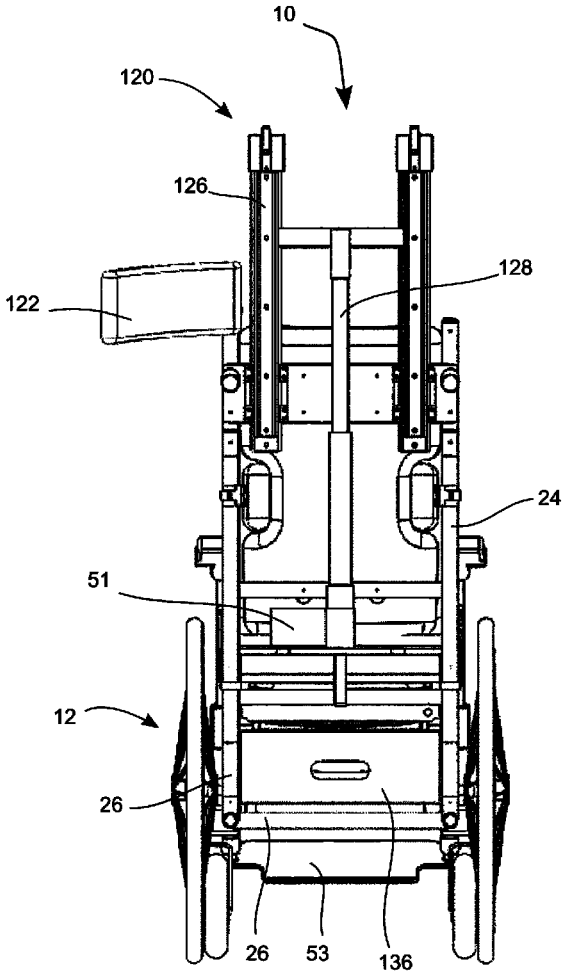

FIG. 24 shows a rear view of the embodiment of FIG. 12 with lifting tower 120 in a raised position. Linear actuator 128 has been powered by motor 51 to move sliding mechanism 126 upward. Headrest 122 has been rotated away from the path of the lifting tower 120 and sling (not shown). Power pack 53 may be stored under the seat supporting cage 26.

In an embodiment (not shown) but intended to be covered by the claims, the lifting tower may be built along with the frame so that the frame is not readily separable from the lifting tower. If the back of the wheelchair is formed by the lifting tower, then the frame is the parts of the wheelchair that support the seat, including the seat supporting cage, legs and wheels.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A wheelchair, comprising:

a frame supported on wheels, the frame having a back and a front;

a removable seat supported by the frame;

a receptacle supported by the frame under the removable seat;

a lifting tower supported by the frame and a sling carried by the lifting tower;

the sling being operable by the lifting tower through a lifting range to move between positions in which a person carried in the sling is raised above the removable seat so that the removable seat may be removed and a person carried in the sling is lowered to be supported over the receptacle;

the lifting tower including a slide mechanism that extends upward above the frame of the wheelchair from the back of the frame and that includes lever arms that pivot on the part that extends upward above the frame, with forward portions of the lever arms extending over the removable seat, and the sling being suspended from the forward portions of the lever arms;

the lifting tower including a driving component that is separated from the slide mechanism; and the forward portion of the lever arm that forms part of the slide mechanism comprising paired precision extrusions topped by deployable hooks for supporting the sling.

2. The wheelchair of claim 1 in which in the lowered position the person is supported by a toilet seat that is supported by the frame.

3. The wheelchair of claim 1 in which the sling has at least a first supporting section and a second supporting section that are separated to be positionable respectively under the back and legs of the person.

4. The wheelchair of claim 1 in which the sling is suspended from the lifting tower by cables or straps.

5. The wheelchair of claim 1 in which there is a cowling under the toilet seat, between the toilet seat and the receptacle.

6. The wheelchair of claim 1 in which the receptacle comprises a removable bowl and a removable drawer.

7. The wheelchair of claim 1 in which the lifting tower is positioned vertically.

8. The wheelchair of claim 7 in which the frame comprises a removable headrest.

9. The wheelchair of claim 8 in which the headrest is attached to a vertical support of the frame allowing the headrest to be rotated away from the path of the lifting tower and sling.

10. The wheelchair of claim 1 in which the lifting tower in a lowered position does not extend above the height of a traveling configuration of the frame.

* * * * *